US006677903B2

(12) United States Patent
Wang

(10) Patent No.: US 6,677,903 B2
(45) Date of Patent: Jan. 13, 2004

(54) MOBILE COMMUNICATION DEVICE HAVING MULTIPLE FREQUENCY BAND ANTENNA

(75) Inventor: Wang Nan Wang, Limpley Slake (GB)

(73) Assignee: Arima Optoelectronics Corp., Taoyuan (TW)

( * ) Notice: Subject to any disclaimer, the term of this patent is extended or adjusted under 35 U.S.C. 154(b) by 0 days.

(21) Appl. No.: 10/001,194

(22) Filed: Dec. 4, 2001

(65) Prior Publication Data

US 2002/0080074 A1 Jun. 27, 2002

Related U.S. Application Data

(60) Provisional application No. 60/250,519, filed on Dec. 4, 2000.

(51) Int. Cl.[7] ..... H01Q 9/28

(52) U.S. Cl. ..... 343/702; 343/795; 343/700 MS

(58) Field of Search ..... 343/702, 700 MS, 343/795, 793, 906, 767, 846, 868; 455/90

(56) References Cited

U.S. PATENT DOCUMENTS

| | | | | |
|---|---|---|---|---|
| 5,898,404 A | | 4/1999 | Jou | 343/700 MS |
| 5,986,609 A | | 11/1999 | Spall | 343/702 |
| 5,995,052 A | | 11/1999 | Sadler et al. | 343/702 |
| 6,054,954 A | | 4/2000 | Eggleston et al. | 343/700 MS |
| 6,061,028 A | | 5/2000 | Sakata | 343/702 |
| 6,073,027 A | | 6/2000 | Norman et al. | 455/550 |
| 6,094,179 A | | 7/2000 | Davidson | 343/895 |
| 6,140,966 A | | 10/2000 | Pankinaho | 343/700 MS |
| 6,204,826 B1 | | 3/2001 | Rutkowski et al. | 343/895 |
| 6,266,538 B1 | | 7/2001 | Waldron | 455/550 |
| 6,337,666 B1 | * | 1/2002 | Bishop | 343/795 |
| 6,377,226 B1 | * | 4/2002 | Ha et al. | 343/791 |

* cited by examiner

*Primary Examiner*—James Clinger
(74) *Attorney, Agent, or Firm*—McDermott, Will & Emery

(57) ABSTRACT

A mobile communication device comprises an antenna and a housing enclosing a circuit board having communication components disposed thereon to transmit and receive communication signals. The antenna includes a substrate having opposite first and second surfaces, a planar conducting layer, a quarter wave choke strip, and a monopole conducting layer. The planar conducting layer is disposed on the first surface of the substrate, while the quarter wave choke strip and the monopole conducting layer are disposed on the second surface of the substrate. The quarter wave choke strip is electrically coupled to the planar conducting layer and connected to the monopole conducting layer. The antenna may be configured to work in three frequency bands: an upper band, a middle band, and a low band. During operation, the monopole conducting layer works as a monopole radiating in the upper frequency band, the quarter wave choke strip is works in a middle frequency band, and the monopole conducting layer, the quarter wave choke strip, and the planar conducting layer combined work as a monopole radiating in the low frequency band.

27 Claims, 13 Drawing Sheets

MOBILE COMMUNICATION DEVICE HAVING MULTIPLE FREQUENCY BAND ANTENNA

RELATED APPLICATIONS

The present application claims the benefit of priority from U.S. Provisional Patent Application serial No. 60/250,519, entitled "REVERSE ANTENNA MOBILE HANDSETS," filed on Dec. 4, 2000.

FIELD OF INVENTION

The present invention relates to a mobile communication device having concealed antennas, and more particularly, to a mobile communication device having asymmetrical antennas that operate in multiple frequency bands.

BACKGROUND OF INVENTION

Mobile communication devices typically include an antenna for transmitting and/or receiving wireless communication signals. It is desirable to design an antenna that allows wireless communication devices to operate in different frequency bands.

For example, GSM (Global System for Mobile communication) is a digital mobile telephone system that typically operates at a low frequency band, such as between 880 MHz and 960 MHz. DCS (Digital Communication System) is a digital mobile telephone system that typically operates at high frequency bands between 1710 MHz and 1880 MHz. PCS (Personal Communication Services), another digital mobile telephone system, uses a band between about 1850 MHz and 1990 MHz, and GPS (Global Positioning System) uses 1570 MHz band. It would be desirable to have the same mobile communication device working properly under these different frequencies. In order to achieve this goal, an antenna capable of transmitting and receiving signals in these frequencies has to be provided.

Certain design criteria must be followed in designing antennas for mobile communication devices. One such limitation is that the distance between the antenna and the circuit board should be larger than one-eighth the wavelength used by the communication device to avoid interference occurring therebetween. However, as the dimensions of mobile communication devices continue to reduce, this physical limitation is difficult to satisfy, especially for concealed antennas disposed inside the mobile communication devices.

Users of mobile communication devices, especially users of mobile phones, have been worried about possible health impacts caused by exposure to electromagnetic waves transmitted from and received by the antennas. One specific concern is that high frequency signals may cause brain tumors. Although there is insufficient medical evidence for such allegation, mobile phone users prefer antennas to be placed as far away as possible from their heads.

Therefore, there is a need for an antenna capable of transmitting signals in multiple signal bands. There is another need to reduce dimensions of wireless communication devices and at the same time suppress signal interference caused by the circuit board of the communication device. Still another need exists for placing mobile phone antennas as far away as possible from users. These and other needs are addressed by the present invention.

SUMMARY OF THE INVENTION

The invention provides a wireless communication device having a multiple frequency band antenna so that the wireless communication device is capable of working under different signal frequencies. The invention is advantageous in that the antenna is disposed in a location away from a user's head, such as on the flip or slide panel of a mobile phone. The invention is also advantageous in providing an optimized design for concealed antennas and maintaining proper distance between the antenna and the circuit board of the wireless communication device.

A mobile communication device according to the invention comprises an antenna and a housing enclosing a circuit board having communication components disposed thereon to transmit and receive communication signals. The antenna includes a substrate having opposite first and second surfaces, a planar conducting layer, a quarter wave choke strip, and a monopole conducting layer. The planar conducting layer is disposed on the first surface of the substrate, while the quarter wave choke strip and the monopole conducting layer are disposed on the second surface of the substrate. The quarter wave choke strip is electrically coupled to the planar conducting layer and connected to the monopole conducting layer.

In one aspect of the invention, the antenna is configured to work in three frequency bands: an upper frequency ban, a middle frequency band, and a low frequency band. For example, the low frequency band may be the GSM band, the middle band may be the DCS band, and the upper band may be the PCS band. During operation, the monopole conducting layer may be configured to work as a monopole radiating in the upper frequency band, the quarter wave choke strip may be configured to work as the middle frequency band, and the monopole conducting layer, the quarter wave choke strip, and the planar conducting layer combined may be configured to work as the monopole radiating in the lower frequency band.

The antenna may be configured to operate in other numbers of bands, such as two bands, four bands, and so one. In addition, different operation frequencies may be selected depending on design requirements.

In anther aspect, the planar conducting layer has a substantially quadrilateral shape. The planar conducting layer may be coupled to the quarter wave choke strip via a metalized hole. The quarter wave choke strip may be substantially overlapping with the planar conducting layer.

The mobile communication device may have a panel slidely or rotatably attached to the housing. The panel may include a microphone for capturing a voice signal from the user. In one aspect, the substrate may be disposed on the panel. When the user slides or flips out the panel, the extended panel provides an extending portion from the housing. Thereby, the distance between the circuit board and the antenna is extended to avoid interference caused by the circuit board.

A multiple frequency band antenna according to the invention may include a substrate, such as a dielectric substrate, comprising opposite first and second surfaces, a first planar conducting layer, a conducting layer strip, and a second planar conducting layer. The first planar conducting layer is disposed on the first surface of the substrate and may have a substantially quadrilateral shape. The conducting layer strip is disposed on the second surface and has a free end formed within an area overlapping with the planar conducting layer, and a second end extending from the free end in an direction towards an edge of substrate. The conducting layer strip is coupled to the first planar conducting layer via a conducting device, such as a metal vial (metal hole).

In one aspect, the second planar conducting layer is configured to couple to a circuit board. As an alternative, the first planar conducting layer is configured to couple to a circuit board. The antenna may include a connecting device having a first end connected to the first planar conducting layer and a second end configured to couple to the circuit board.

In still another aspect, the antenna is configured to radiate in an upper frequency band, a middle frequency band, and a low frequency band. The second planar conducting layer may radiate as a monopole in the upper frequency band, the conducting strip may radiate in the middle frequency band, and the second planar conducting layer, the conducting strip, and the first planar conducting layer combined may radiate as a monopole in the low frequency band.

The conducting layer strip may be configured to work as an inductor in the low frequency band, and the second planar conducting layer does not overlap with the first planar conducting layer.

Still other advantages of the present invention will become readily apparent from the following detailed description, simply by way of illustration of the invention and not limitation. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The accompanying drawings, which are incorporated in and constitute a part of the specification, illustrate embodiments of the present invention and, together with the description, serve to exemplify the principles of the present invention.

DETAILED DESCRIPTION OF PREFERRED EMBODIMENTS

Figure 1A:
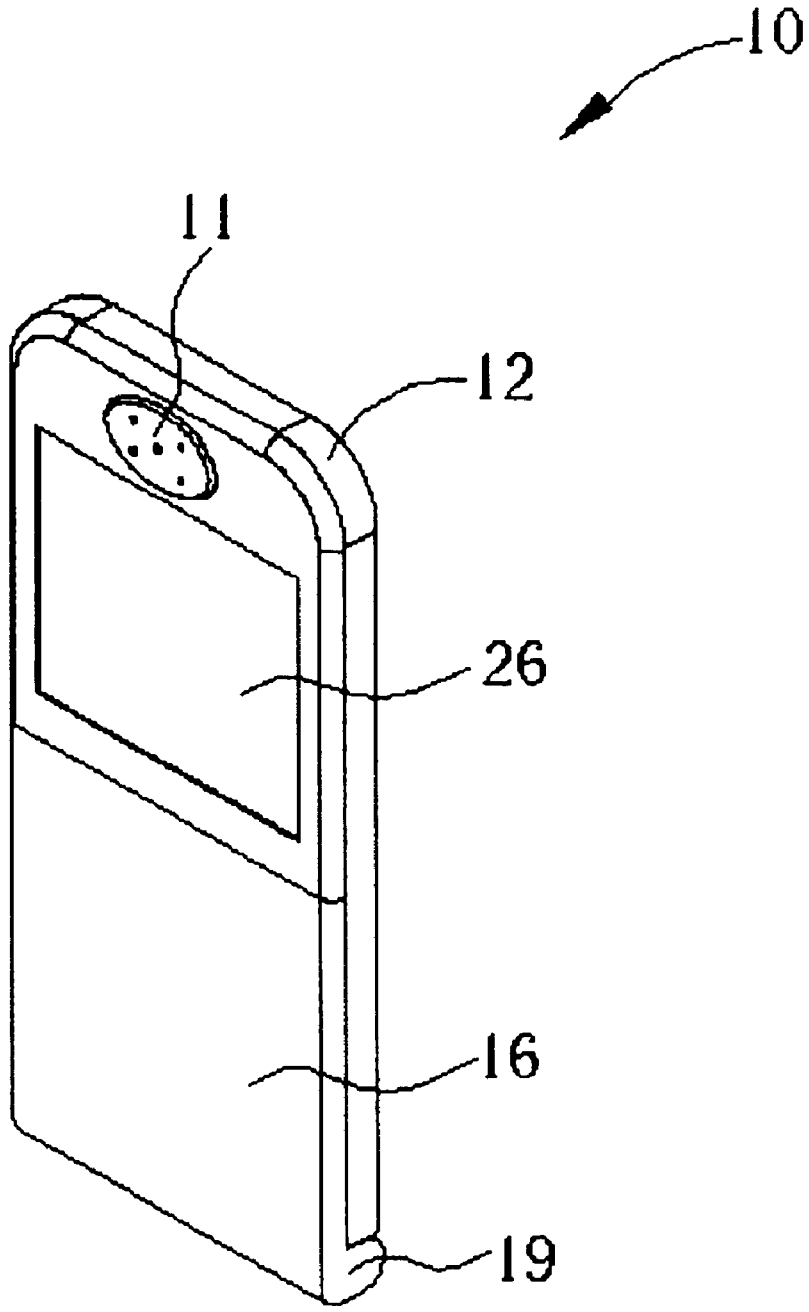
FIGS. 1*a* and 1*b* show a mobile phone upon which the present invention may be implemented.
Figure 1B:
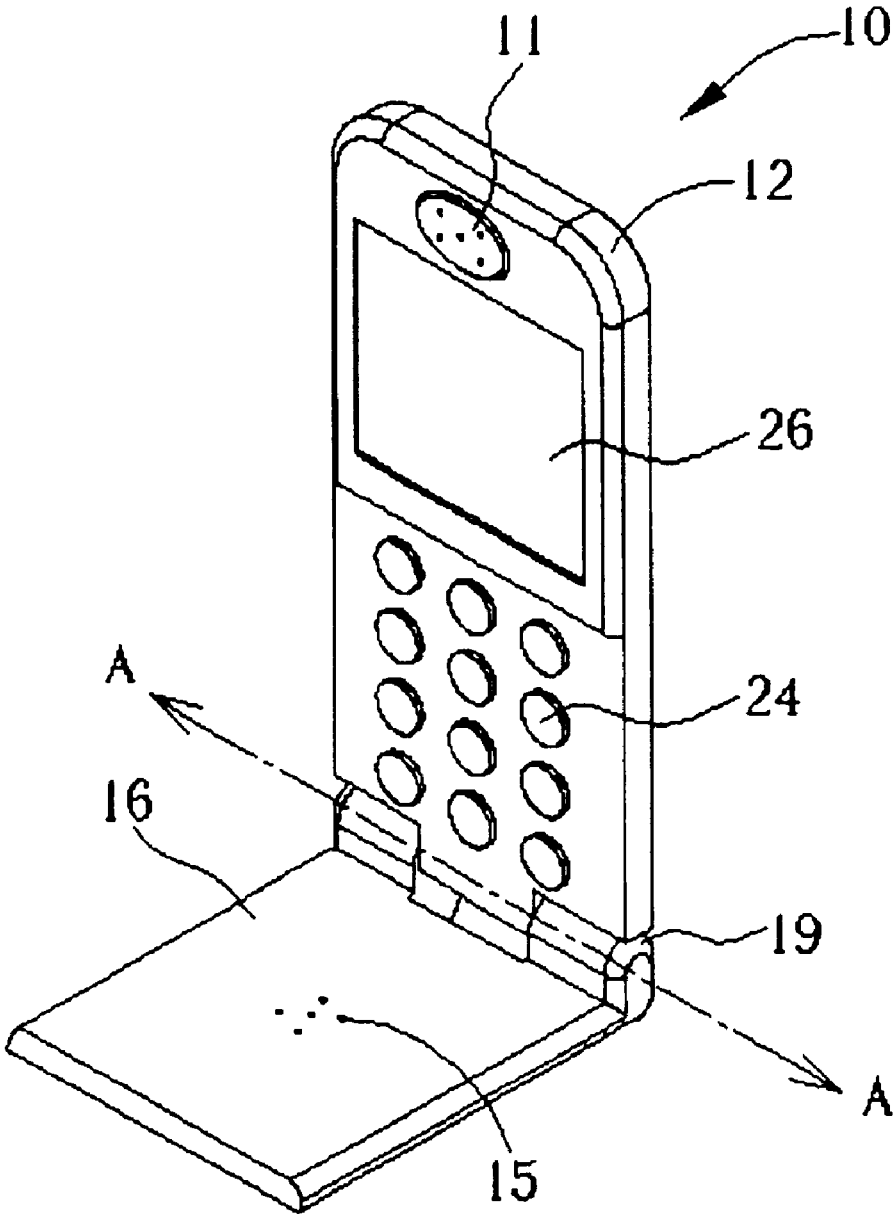

FIGS. 1*a* and 1*b* show a mobile phone 10 upon which the invention may be implemented. The antenna has a flip panel 16 operating between a closed position (FIG. 1*a*) and an open position (FIG. 1*b*). Mobile phone 10 includes housing 12 that houses a plurality of keys 24, a display 26, and electronic components that enable mobile phone 10 to transmit and receive communications signals. A flip panel 16 is hinged to one end of housing 12 via hinges 19.

Figure 2:
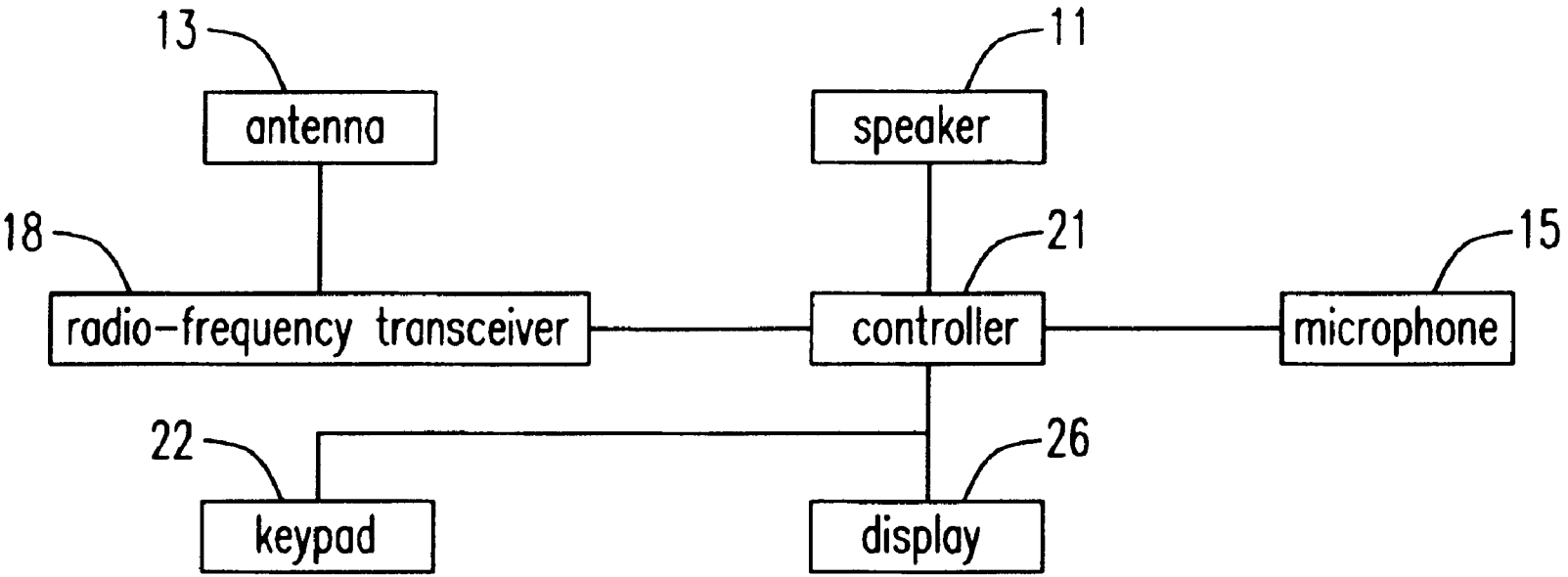
FIG. 2 illustrates a block diagram of a mobile phone upon which the present invention may be implemented.

In operation, the flip panel 16 may be pivoted by a user about axis A between the closed and open positions. When the flip panel 16 is in the closed position, the panel may provide protection to the keys 24 from unintentional activation. When the panel is in the open position, the panel may provide a convenient extension to the mobile phone 10. When the panel is fitted with a microphone 15, the microphone 15 can be favorably positioned to receive a voice signal input from a user. Speaker 11 allows a user to hear audio communications transmitted by another communication device FIG. 2 shows a block diagram of a mobile phone illustrated in FIG. 1. An antenna 13 for receiving and transmitting communication signals is electrically connected to a radio-frequency transceiver 18 that is in signal communication with a controller 21. Controller 21 is configured to process signals received or to be sent by the antenna 13. Controller 21 is coupled to a speaker 16 that transmits an audible signal from the controller 21 to a user of the communication device. The controller 21 is also in signal communication with a microphone 15 that receives a voice signal from a user and transmits the voice signal through the controller 21. The controller 21 is electrically connected to input keys 24 of keypad 22 and display 26 that facilitate operation of the mobile phone 10.

In order to maximize power transfer between an antenna and a transceiver, the transceiver and the antenna are preferably interconnected such that their respective impedance are substantially "matched," i.e., electrically tuned to filter out or compensate for undesired antenna impedance components to provide a desired impedance value at the feed point, such as 50 Ohms.

Figure 3A:
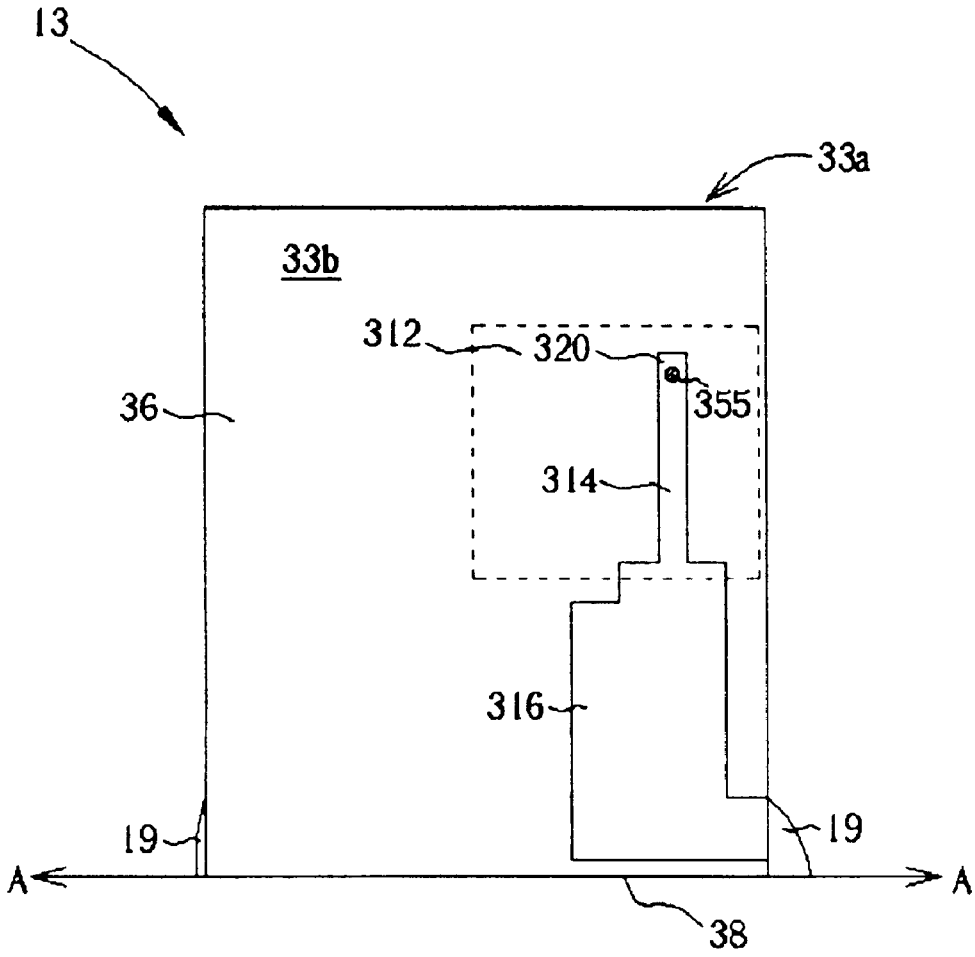
FIGS. 3*a*–3*d* show an example of an antenna and a mobile phone according to the present invention.
Figure 3B:
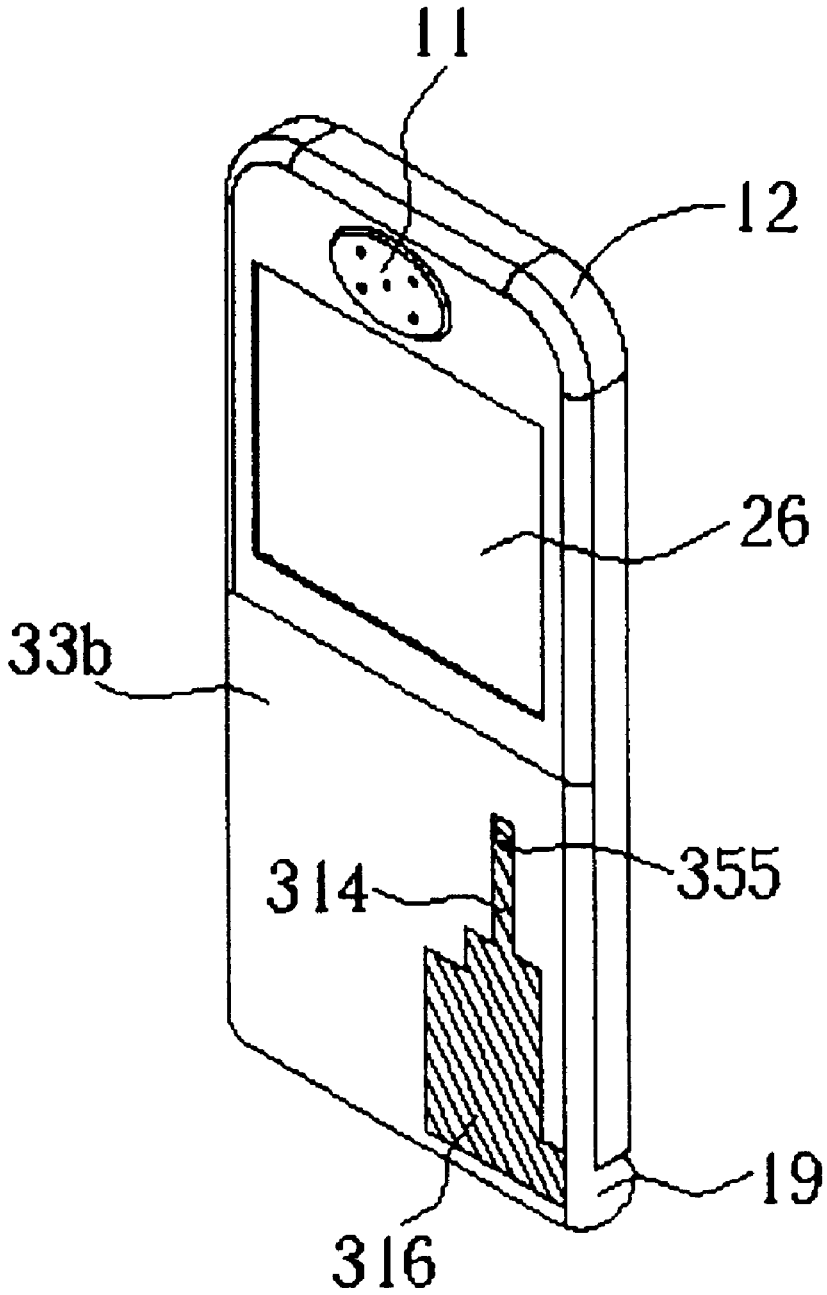
Figure 3C:
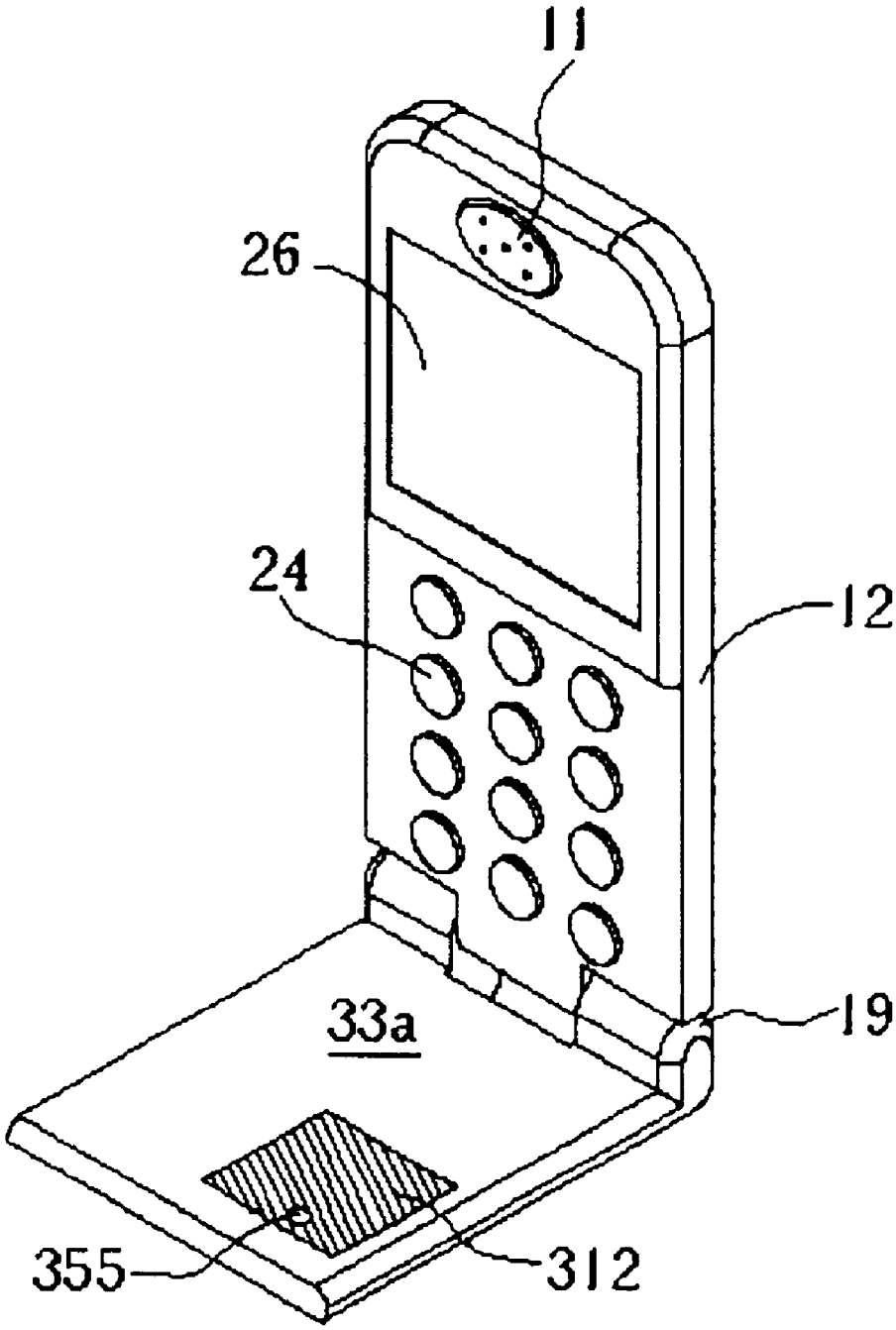

FIGS. 3*a*–3*c* show an exemplary antenna according to the present invention implemented on a mobile phone illustrated in FIGS. 1 and 2. In FIG. 3*a,* the antenna is disposed on a substrate 36, such as a fiberglass circuit board. The substrate 36 has first and second opposite surfaces 33*a* and 33*b*. The substrate 36 may be disposed on a flip panel 16 illustrated in FIGS. 1 and 2 along with a speaker 15. FIGS. 3*b* and 3*c* show a mobile phone 10 with an antenna of FIG. 3*a* (with microphone 10 and cover removed for purpose of illustration). The first surface 33*a* faces the input keys 24 when the flip cover 16 is in the closed position (see FIG. 3*c*), while the second surface 33*b* is a surface opposite to the first surface 33*a* (see FIG. 3*b*).

The antenna comprises of a plurality of conducting layer sections, such as copper, working as radiating segments. The antenna includes a first planar conducting layer, such as planar conducting layer 312 (shown in dotted lines), disposed on the first surface 33*a* of substrate 36. Additionally, the antenna has a conducting layer strip, such as a quarter wave choke strip 314, and a second planar conducting layer, such as a monopole conducting layer 316, both of which disposed on the second surface 33*b* of substrate 36.

The planar conducting layer 312 has a substantially quadrilateral shape and is coupled to the quarter wave choke strip 314 disposed on the opposite surface via a metalized hole 355. The quarter wave choke strip 314 is a long strip having a free end 320. The quarter wave choke strip extends from the free end 320 in a direction towards an edge 38 of the substrate 36 near hinges 19. The quarter wave choke strip 314 connects to the monopole conducting layer 316.

The quarter wave choke strip 314 is disposed within an area substantially overlapping with the planar conducting layer 312, while the monopole conducting layer 316 is disposed in a way avoiding overlapping with the planar conducting layer 312.

In order to transmit radio frequency (RF) energy with minimum loss, or to pass along received RF energy to a receiver with minimum loss, the impedance of the antenna is matched to the impedance of a transmission line or feed point, which is point 350.

The antenna may be configured to operate under a plurality of frequency bands. For example, the antenna may be configured to work in three bands: an upper frequency band, such as a band between about 1850 MHz and 1990 MHz for PCS (Personal Communication Services) signals, a middle frequency band, such as a band between 1710 MHz and 1880 MHz for DCS (Digital Communication System) signals, and a low frequency band, such as the GSM (Global System for Mobile communication) band between 880 MHz and 960 MHz.

In operation, the monopole conducting layer 316 radiates in the upper frequency band, the quarter wave choke strip 314 radiates in the middle frequency band, and the combination of the planar conducting layer 312, the quarter wave choke strip 314, and the monopole conducting layer 312 radiates in the low frequency band. The quarter wave choke strip 314 may additionally work as an inductor in the low frequency band.

While the above example is described using three frequency bands, other number of frequency bands may be used depending on design preference.

Figure 3D:
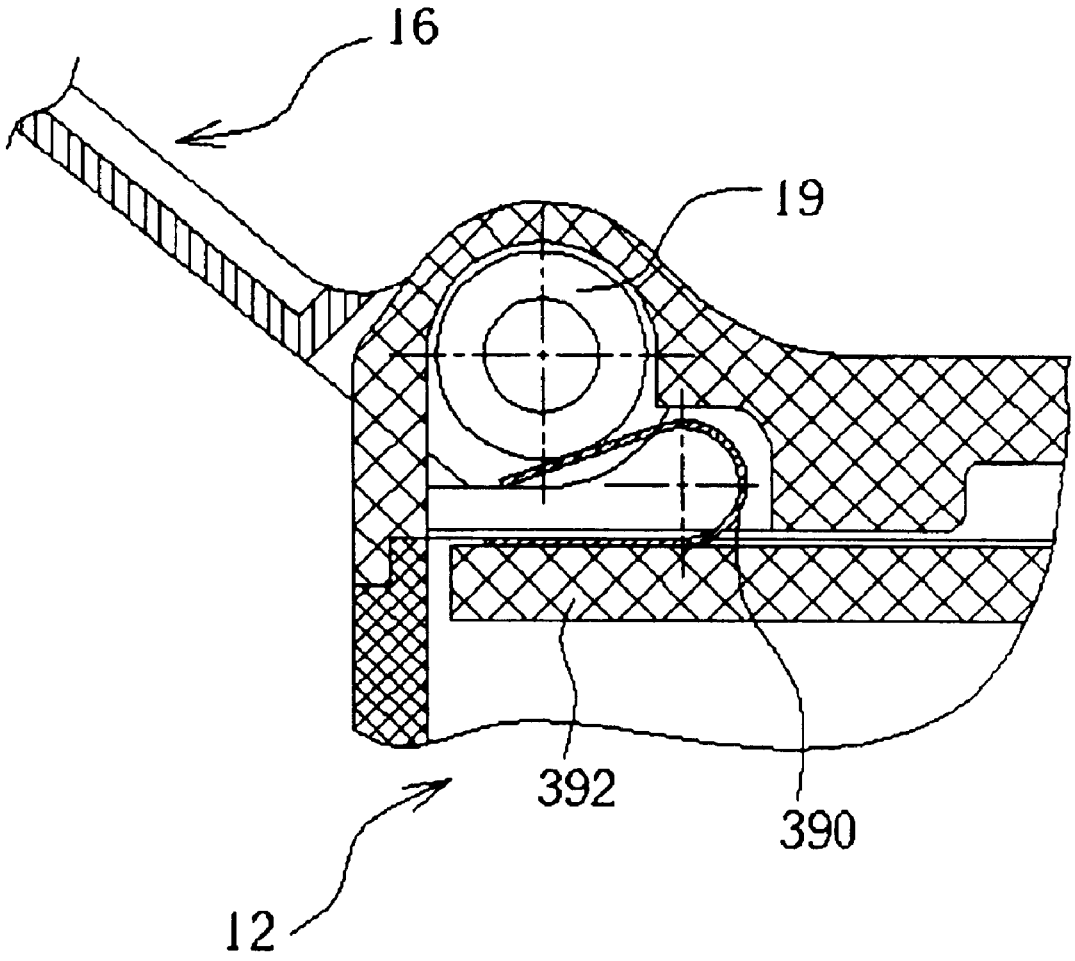

The antenna must couple to the circuit board of the mobile phone in order to transmit signals therebetween. FIGS. 3*b* and 3*d* illustrate an example of contact arrangement between the antenna and the circuit board of the mobile phone. In FIG. 3*b,* monopole conducting layer 316 is formed on the substrate 36 and connected to hinge 19. Hinge 19 may be made from signal conducting material, such as copper, for purpose of conducting signals from the antenna. FIG. 3*d* is a detailed view of flip panel 16, hinge 19, spring 390, and circuit board 392. Since the antenna on the flip panel 16 is connected to hinge 19, as illustrated in FIG. 3*b,* hinge 19, spring 390, and circuit board 392 form a signal path for transmitting signals from the antenna to the circuit board 392, or vice versa.

Other design options for conducting signals between the circuit board and the antenna may also be used. For example, a fine wire or conducting plastic strip containing conducting wires may be used to connect the antenna to the circuit board.

In one aspect, the substrate including the antenna may be a separate part from the housing 12 of the mobile phone and connected to the mobile phone only when necessary. In this example, the antenna is a secondary antenna for assisting signal transmission when the primary antenna of the mobile phone is unable to provide satisfactory signal level.

While certain descriptions in the above illustrate the invention based on the first and second surfaces, the conducting sections can be arranged in an inverse way by placing the planar conducting layer 312 on the first surface 33*a,* and the quarter wave choke strip 314 and the monopole conducting layer 316 on the second surface 33*b*. The dimensions of the conducting sections can be rearranged to optimize transmission/receiving performance. However, it is preferable to alter the dimensions in a way that maintains a constant self impedance (~Li/Ci) of each antenna segments radiating in different frequency bands.

Since the antenna according to the present invention may be disposed on the rotatable flip panel 16 attached to a mobile phone, when the flip panel is in the open position, the antenna extends further away from the user, as illustrated in FIGS. 1*b* and 3*c*. Therefore, the antenna is farther from the user's head than antennas disposed inside or on top of the mobile phone. This feature is appealing to users who are concerned about potential health risks caused by electromagnetic waves.

In addition, disposing the antenna on the extendible flip panel increases the distance between the antenna and the circuit board. Thus, the interference caused by the circuit board will be reduced compared to antennas disposed inside or on top of the mobile phone.

Figure 4A:
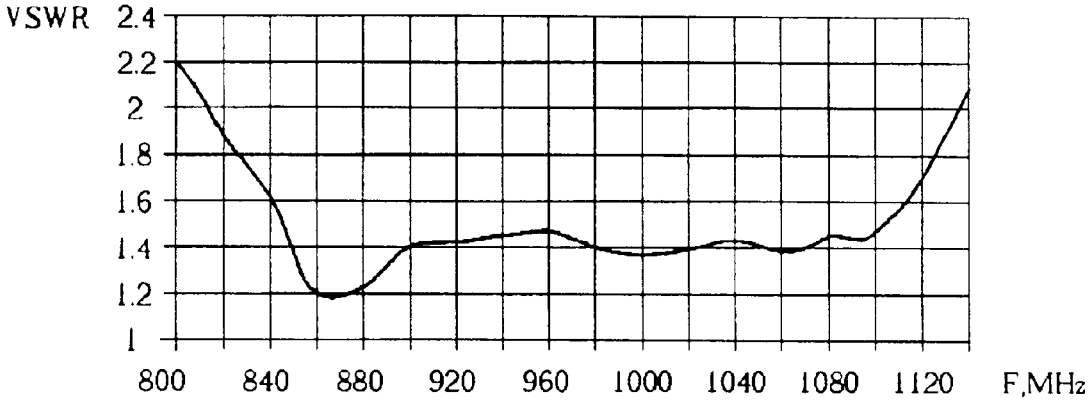
FIGS. 4*a* and 4*b* depict VSWR curves of an antenna according to the present invention.
Figure 4B:
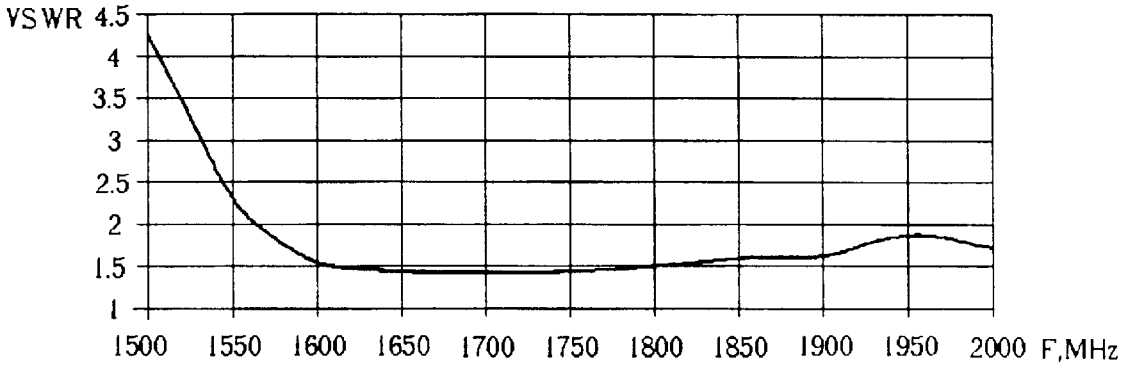

Voltage Standing Wave Ratio (VSWR) relates to the impedance match of an antenna feed point with a feed line or transmission line of a communications device, such as a mobile phone. FIGS. 4*a* and 4*b* show VSWR (Voltage Standing Wave Ratio) curves relative to frequencies of the antenna described above. Generally, VSWR values less than 2.0 are preferable.

According to FIGS. 4*a* and 4*b,* the VSWR curves of the antenna illustrate excellent VSWR characteristics spanning from 810 MHz to 1010 MHz and 1550 MHz to 2000 MHz. As discussed above, GSM operates between 880 MHz and 960 MHz, DCS uses frequency between 1710 MHz and 1880 MHz, PCS operates between 1850 MHz and 1990 MHz, and GPS uses 1570 MHz band. Apparently, the antenna provides superior VSWR characteristics across the frequency bands used by the communication systems and thus is capable of working properly under different communication frequencies and protocols.

Figure 5:
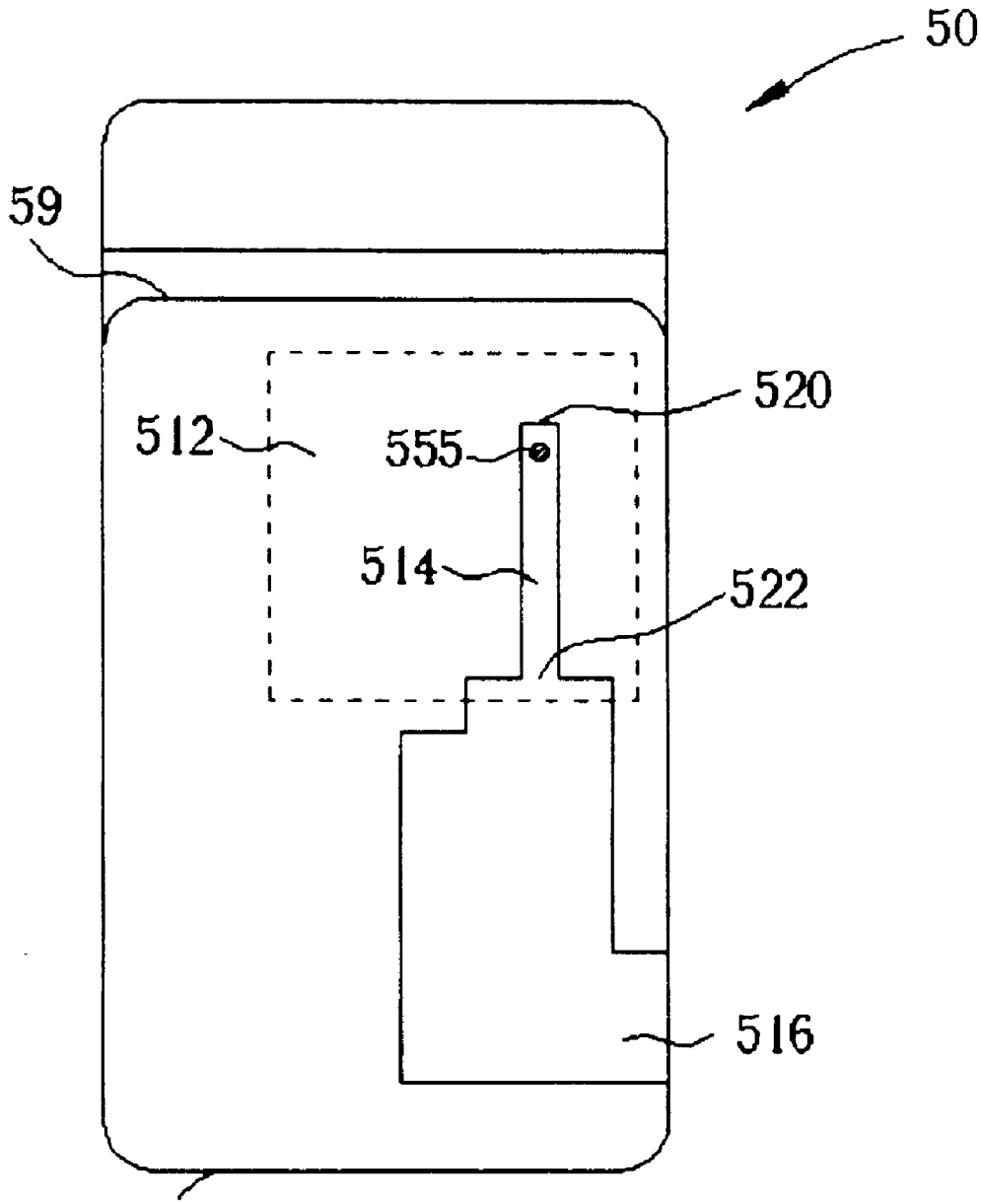
FIG. 5 is a back view of a mobile communication device having an antenna according to another embodiment of the present invention, disposed within the housing of the communication device.

FIG. 5 depicts a second embodiment of the present invention. The antenna of FIG. 5 has a structure to that described above and is disposed inside a mobile phone 50 or formed as part of a back cover 55 of mobile phone 50.

The antenna includes a substrate comprising opposite first and second surfaces, a planar conducting layer 512 having a substantially quadrilateral shape disposed on the first surface. On the second surface of the substrate, a quarter wave choke strip 514 is formed and has a free end 520 formed within an area overlapping with the planar conducting layer 512. The quarter wave choke strip 514 has a second end 522 extending in a direction towards an edge 57 of the substrate.

The quarter wave choke strip 514 electrically coupled to the planar conducting layer 512 via a metalized hole 555 formed on the substrate. The monopole conducting layer 516 connects to the feed line conducting strip 510 via a metalized hole 550 formed on the electric substrate. The antenna may be coupled to the circuit board of the mobile phone as discussed in the previous embodiment.

Figure 6A:
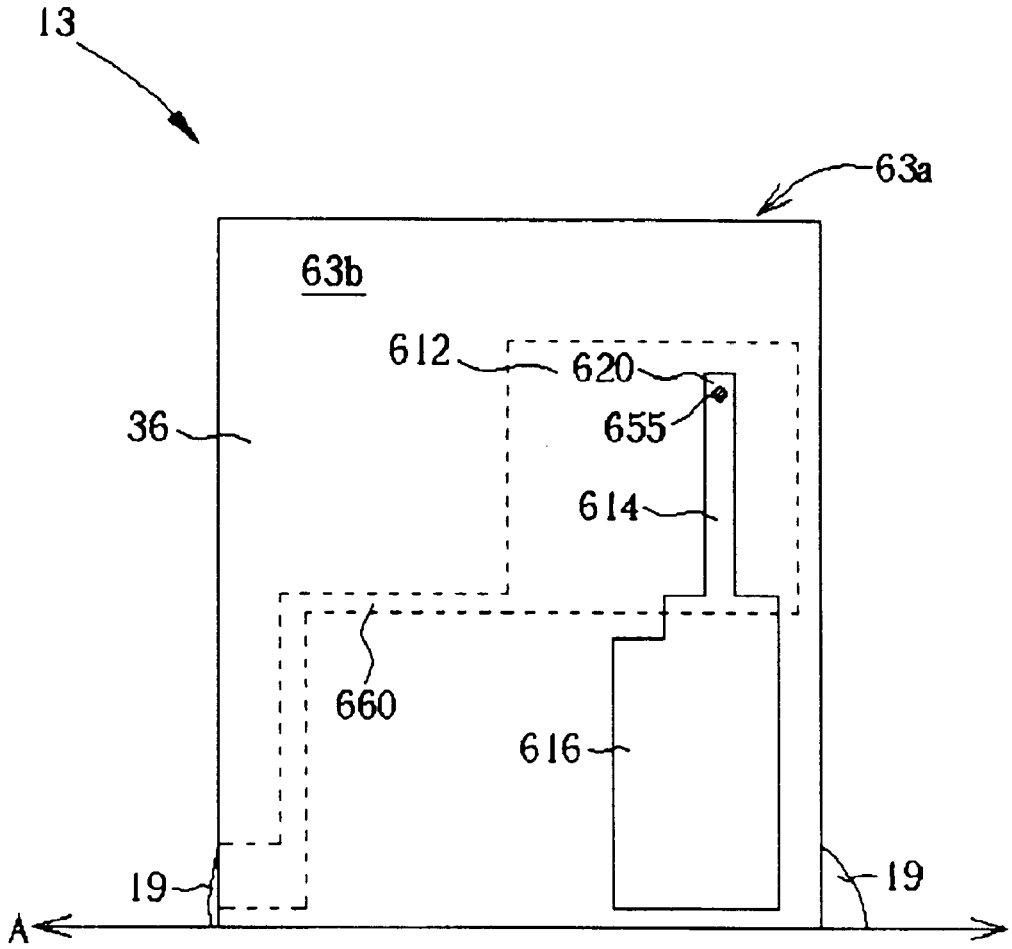
FIGS. 6*a*–6*c* show an example of an antenna and a mobile phone according to a third embodiment of the invention.
Figure 6B:
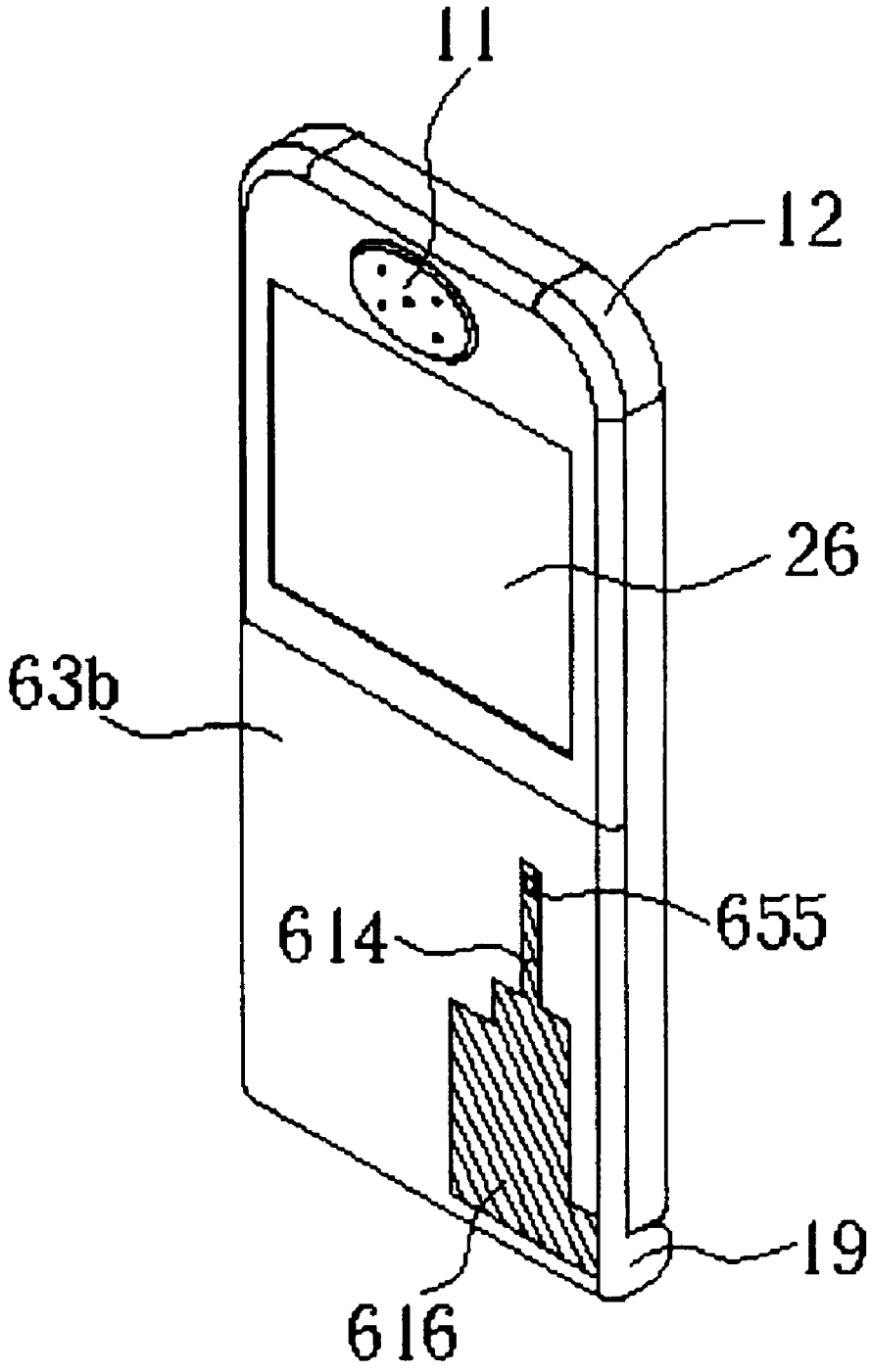
Figure 6C:
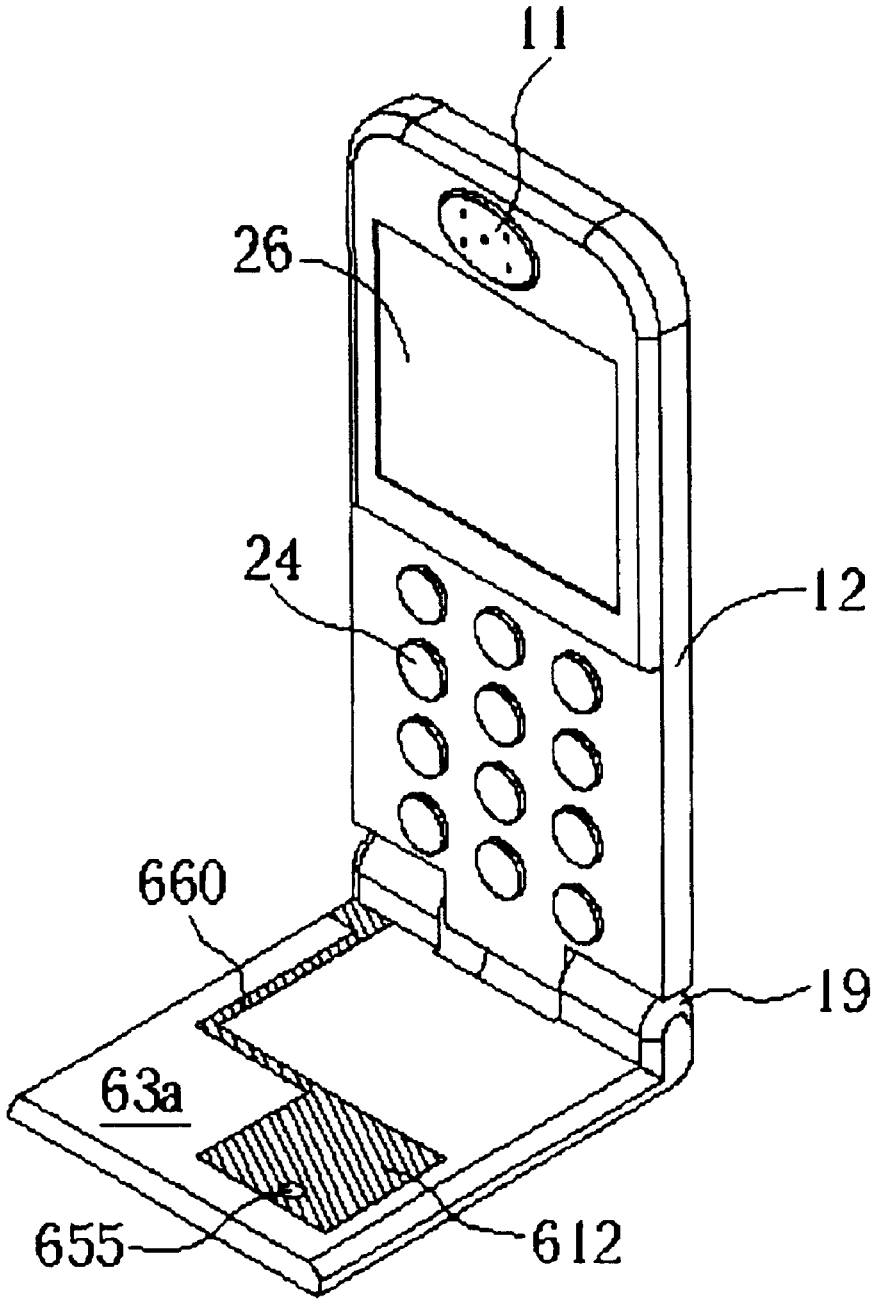

FIGS. 6*a*–6*c* show another embodiment of the invention. The antenna has a structure similar to that illustrated in FIGS. 3*a*–3*d,* but coupling to the circuit board via the planar conducting layer 612 instead of the monopole conducting layer shown in FIGS. 3*a*–3*d*. The planar conducting layer has a conducting device, such as a conducting strip 660 shown in FIG. 6*a*. The conducting strip 660 connects the planar conducting layer 612 to hinge 19 which is coupled to the circuit board in a way similar to that discussed in FIG. 3*d*. While the a conducting strip is used for illustration, other means for conducting signals from the planar conducting layer to the circuit board can also be used. For example, a fine wire or conducting plastic strip containing conducting wires may be used to connect the antenna to the circuit board.

It is understood by people skilled in the art that the antenna configuration may be altered so that the antenna performs differently to suit specific frequencies and purposes of use. Therefore, the sizes and positions of the conducting sections can be manipulated to obtain optimized transmission and receiving qualities. The shape of the conducting sections can also be altered as well.

Antennas according to the invention may also be used with communications devices that only transmit or only receive radio frequency signals. Such devices that only receive signals may include conventional AM/FM radios or any receiver utilizing an antenna. Devices that only transmit signals may include remote data input devices.

Those skilled in the art will recognize, or be able to ascertain using no more than routine experimentation, many equivalents to the specific embodiments of the invention specifically described herein. Such equivalents are intended to be encompassed in the scope of the following claims.

What is claimed is:

1. A multiple frequency band antenna, comprising:

a substrate comprising opposite first and second surfaces;

a planar conducting layer having a substantially quadrilateral shape disposed on the first surface;

a monopole conducting layer disposed on the second surface; and a quarter wave choke strip disposed on the second surface having one end electrically connected to the monopole conducting layer and a free end, the free end electrically coupled to the planar conducting layer disposed on the opposite surface;

wherein the antenna is configured to radiate in an upper frequency band, a middle frequency band, and a low frequency band, the monopole conducting layer is configured to radiate as a monopole in the upper frequency band, the quarter wave choke strip is configured to radiate in the middle frequency band; and the monopole conducting layer, the quarter wave choke strip, and the planar conducting layer combined are configured to radiate as a monopole in the low frequency band.

2. The antenna of claim 1, wherein the monopole conducting layer is configured to couple to a circuit board having communication components disposed thereon.

3. The antenna of claim 1, wherein the planar conducting layer is configured to couple to a circuit board having communication components disposed thereon.

4. The Antenna of claim 3, wherein the antenna further comprising a connecting device having a first end connected to the planar conducting layer and a second end configured to couple to the circuit board.

5. The antenna of claim 1, wherein the monopole conducting layer does not overlap with the planar conducting layer.

6. A mobile communication device having antenna configured to radiate in an upper frequency band, a middle frequency band, and a low frequency band, comprising:

a housing enclosing a circuit board having communication components disposed thereon;

a substrate comprising opposite first and second surfaces;

a planar conducting layer having a substantially quadrilateral shape disposed on the first surface;

a monopole conducting layer disposed on the second surface; and a quarter wave choke strip disposed on the second surface having one end electrically coupled to the monopole conducting layer and a free end, the free end electrically coupled to the planar conducting layer disposed on the opposite surface.

7. The mobile communication device of claim 6, wherein the planar conducting layer is configured to couple to the circuit board.

8. The mobile communication device of claim 7, wherein the antenna further comprising a connecting device having a first end connected to the planar conducting layer and a second end configured to couple to the circuit board.

9. The mobile communication device of claim 8, wherein the connecting device is a conducting wire.

10. The mobile communication device of claim 6, wherein the monopole conducting layer is configured to radiate as a monopole in the upper frequency band; the quarter wave choke strip is configured to radiate in the middle frequency band; and the monopole conducting layer, the quarter wave choke strip, and the planar conducting layer combined are configured to radiate as a monopole in the low frequency band.

11. The mobile communication device of claim 10, wherein the quarter wave choke strip is configured to work as an inductor in the low frequency band.

12. The mobile communication device of claim 6, wherein the substrate is attached to a flip panel rotatably connected to the housing.

13. The mobile communication device of claim 6, wherein the substrate is disposed on a back cover of the mobile communication device.

14. A multiple frequency band antenna configured to radiate in an upper frequency band, a middle frequency band, and a low frequency band, comprising:

a substrate comprising opposite first and second surfaces;

a planar conducting layer having a substantially quadrilateral shape disposed on the first surface;

a quarter wave choke strip disposed on the second surface and having a free end formed within an area overlapping with the planar conducting layer, and a second end;

a first connecting device for electrically connecting the quarter wave choke strip to the planar conducting layer; and a monopole conducting layer disposed on the second surface and connected to the second end of the quarter wave choke strip.

15. The antenna of claim 14, wherein the monopole conducting layer is configured to couple to a circuit board having communication components disposed thereon.

16. The antenna of claim 14, wherein the planar conducting layer is configured to couple to a circuit board having communication components disposed thereon.

17. The Antenna of claim 16, wherein the antenna further comprising a connecting device having a first end connected to the planar conducting layer and a second end configured to couple to the circuit board.

18. The antenna of claim 14, wherein the monopole conducting layer is configured to radiate as a monopole in the upper frequency band; the quarter wave choke strip is configured to radiate in the middle frequency band; and the monopole conducting layer, the quarter wave choke strip, and the planar conducting layer combined are configured to radiate as a monopole in the lower frequency band.

19. A multiple frequency band antenna configured to radiate in an upper frequency band, a middle frequency band, and a low frequency band, comprising:

a substrate comprising opposite first and second surfaces;

a first planar conducting layer having a substantially quadrilateral shape disposed on the first surface;

a conducting layer strip disposed on the second surface and having a free end formed within an area overlapping with the planar conducting layer, and a second end extending from the free end in a direction towards an edge of substrate, wherein the conducting layer strip is coupled to the first planar conducting layer; and a second planar conducting layer disposed on the second surface and connecting to the second end of the conducting layer strip.

20. The antenna of claim 19, wherein the second planar conducting layer is configured to couple to a circuit board having communication components disposed thereon.

21. The antenna of claim 19, wherein the first planar conducting layer is configured to couple to a circuit board having communication components disposed thereon.

22. The antenna of claim 21, wherein the antenna further comprising a connecting device having a first end connected to the first planar conducting layer and a second end configured to couple to the circuit board.

23. The antenna of claim 19, wherein the second planar conducting layer is configured to radiate as a monopole in the upper frequency band, the conducting strip is configured to radiate in the middle frequency band; and the second planar conducting layer, the conducting strip, and the first planar conducting layer combined are configured to radiate as a monopole in the low frequency band.

24. The antenna of claim 23, wherein the conducting layer strip is configured to work as an inductor in the low frequency band.

25. The antenna of claim 19, wherein the first planar conducting layer is coupled to the conducting layer strip via a metalized hole.

26. The antenna of claim 19, wherein the second planar conducting layer does not overlap with the first planar conducting layer.

27. The antenna of claim 19, wherein the conducting layer strip and the first conducting layer is connected via a metal hole.

* * * * *